United States Patent [19]

Zabelka

[11] 4,109,137

[45] Aug. 22, 1978

[54] ELECTRIC STEAM GENERATOR

[75] Inventor: Jaroslav Zabelka, Winterthur, Switzerland

[73] Assignee: Sulzer Brothers Ltd., Winterthur, Switzerland

[21] Appl. No.: 720,737

[22] Filed: Sep. 7, 1976

[30] Foreign Application Priority Data

Jan. 30, 1976 [CH] Switzerland ..... 1188/76

[51] Int. Cl.[2] ..... H05B 3/60; F22B 1/30; H01C 10/02

[52] U.S. Cl. ..... 219/285; 219/288; 338/80

[58] Field of Search ..... 219/271–276, 219/284–295; 338/80–86

[56] References Cited

U.S. PATENT DOCUMENTS 1,409,670 3/1922 Chubb ..... 338/56 X

FOREIGN PATENT DOCUMENTS 168,622 7/1951 Austria ..... 219/284
520,547 2/1921 France ..... 219/291
410,256 3/1925 Fed. Rep. of Germany ..... 219/284
685,856 12/1939 Fed. Rep. of Germany ..... 219/284
728,299 11/1942 Fed. Rep. of Germany ..... 219/288
897,317 11/1953 Fed. Rep. of Germany ..... 219/288
207,778 2/1940 Switzerland ..... 219/288
613,349 11/1948 United Kingdom ..... 219/285

*Primary Examiner*—A. Bartis
*Attorney, Agent, or Firm*—Kenyon & Kenyon, Reilly, Carr & Chapin

[57] ABSTRACT

The electrodes of the steam generator are each formed as a horizontally extending disk to receive descending water jets from a distribution chamber above the electrode as well as with openings to direct water jets downwardly onto a collecting grid. The current flows from the electrodes through the water jets to evaporate part of the water to steam. Movable interceptors are also mounted in the vessel to intercept the water jets for partial loads. Suitable means are also provided for selectively moving the interceptors into the path of the water jets at partial loads.

8 Claims, 3 Drawing Figures

ELECTRIC STEAM GENERATOR

This invention relates to an electric steam generator and particularly a steam generator wherein jets of water are directed onto electrodes.

Heretofore, electric steam generators have been known in which at least one electrode is arranged in a vessel with a distribution device for directing the water to be evaporated against the electrode in the form of jets. Generally, the electrodes have been arranged vertically about a central distribution device, the electrodes being connected to a three-phase network. In use, a current flows through the water jets so that part of the water of the jets evaporates. The steam formed in this manner is collected in the vessel and is then fed to the steam consumers while the unevaporated water returns to a sump located in the lower part of the vessel and forms further current paths.

If the consumption of electric power changes, a larger or smaller number of the water jets emanating from the distribution device is intercepted in these known steam generators so as not to reach the electrodes.

However, because of the vertical arrangement and the distribution device producing curved water jets which require the intercept area of the electrodes in the vertical direction to be rather larger, these steam generators have usually been of relatively large overall height.

Accordingly, it is an object of the invention to provide an electric steam generator of relatively small overall height.

It is another object of the invention to provide an electric steam generator which has a large steam generating capacity relative to the volume of the generator.

Briefly, the invention provides an electric steam generator which comprises a vessel in which at least one electrode for heating water to steam is mounted along with a distribution means located above the electrode. The electrode is formed as a horizontally extending dish for receiving a supply of water and has openings forming outlets for the received water to form vertical water jets. The distribution means has a chamber to receive water, which chamber includes a horizontal bottom having a group of openings above the dish-shaped electrode for directing vertical water jets against the electrode.

Due to the fact that the openings in the distribution means are arranged in a horizontal plane and the electrode is in the form of a horizontal dish, the height of the electrode and thereby, the overall height of the steam generator can be reduced substantially. This makes it possible to accommodate the steam generator in a basement of a normal story height in dwellings, hospitals or similar buildings. Due to the dish-shaped form of the horizontal electrode and the horizontal arrangement of the openings on the distribution means, a uniform vertical straight-line path of the water jets emanating from the distribution means is obtained. This makes it possible to increase the steam generating capacity over vertically arranged electrodes.

In addition, the steam generator includes a means for selectively intercepting the flow of water in the water jets between the distribution means and electrode as well as a means for moving the intercepting means acroSs the water jets in order to intercept and divert a number of the water jets away from the electrode. In this regard, the number of water jets intercepted is proportional to the distance which the intercepting means moves.

These and other objects and advantages of the invention will become more apparent from the following detailed description and appended claims taken in conjunction with the accompanying drawings in which:

Figure 1:
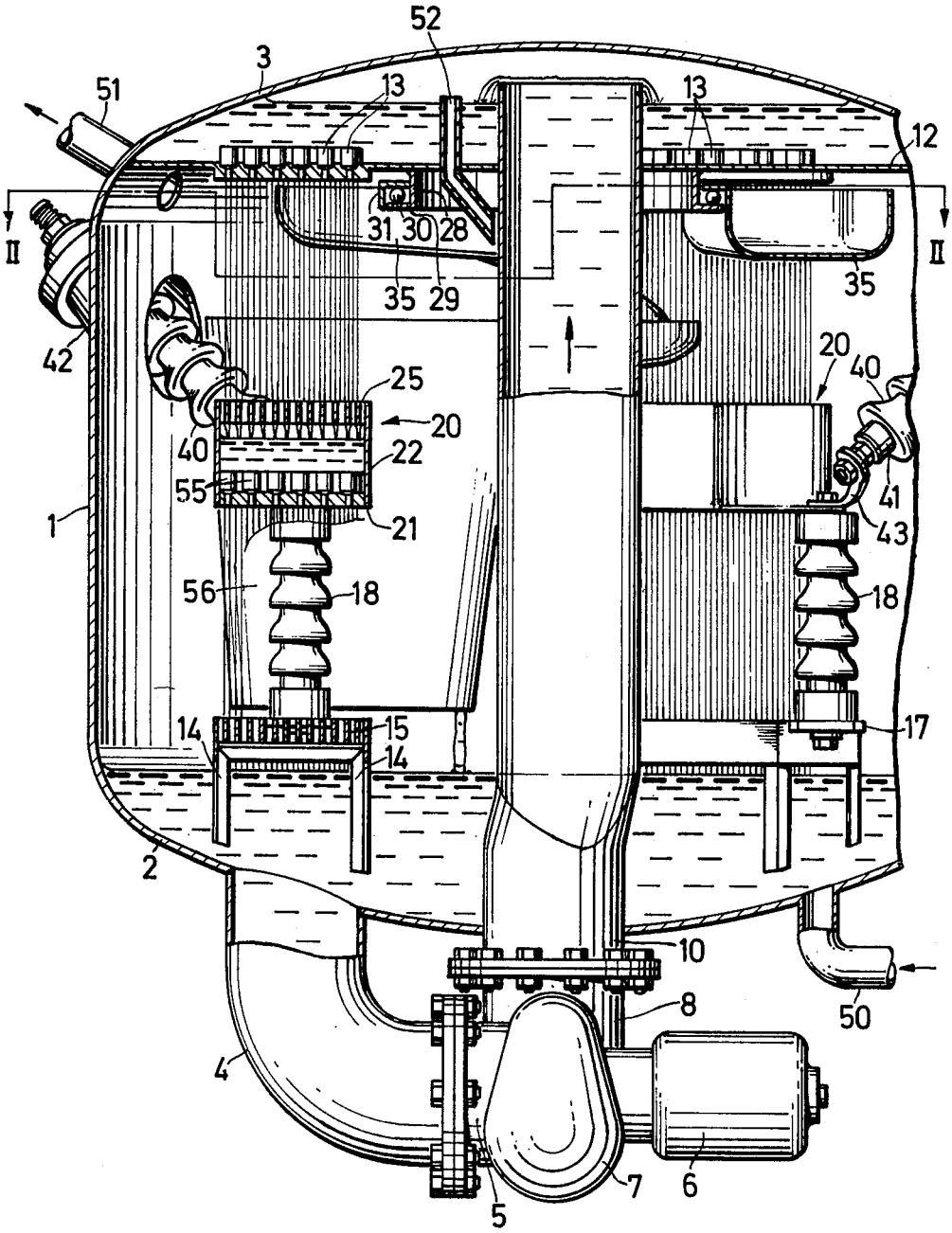
FIG. 1 illustrates a vertical cross-sectional view through a steam generator according to the invention.

Referring to FIG. 1, the electric steam generator has a cylindrical vessel 1 disposed on a vertical axis which is provided at the top and bottom with a convex cover 3 and 2, respectively. The diameter of the vessel 1 is approximately equal to the height of the vessel, so that the vessel 1 is of compact shape. A pipe elbow 4 is connected to the lower cover 2 and is connected via a flange joint to an intake stub 5 of a circulating pump 7, which is driven by an electric motor 6. An output stub 8 of the circulating pump 7 is flanged to a central pipe 10 which passes through the lower cover 2 and extends close to the upper cover 3. The lower end of the pipe 10 is cylindrical and changes toward the top to a triangular cross-section with rounded corners (see FIG. 2).

A pipe line 50 is also connected to the lower cover 2 through which feed water is supplied by means of a feed pump (not shown) and forms a sump in the lower part of the vessel 1.

A plane intermediate plate 12 is provided below the mouth of the central pipe 10 in the vicinity of the upper cover 3 or at the same height as this mouth. This intermediate plate 12 is part of a distribution means for the water to be evaporated, which water collects on the intermediate plate 12 as a layer of a certain height. The plate 12, as shown, forms a horizontal bottom of a chamber to receive water from the pipe 10.

At approximately half height of the vessel 1, three dish-shaped electrodes 20 are provided in a horizontal plane, uniformly distributed over the circumference. Each electrode 20 consists of an approximately horizontal bottom 21 and a frame 22 welded thereto, which extends upward and has a segment-shaped top elevation (see FIG. 2). The bottom 21 is equipped with sixty-six (66) nozzles 55, the exit openings of which are arranged at the intersection points of two families of involutes 26 which are mirrorsymmetrical to a radial plane including the axis of the vessel 1. Several mutually parallel grid bars 25 are fastened above the nozzles 55 in the frame 22, which form a grid and are omitted in FIG. 2 to the left of the break line *b* for the sake of clarity.

A collecting grid 15 is provided below each electrode 20 which consists of steel strips 16 arranged on edge side-by-side and rests via four legs 14 on the lower cover 2. Each electrode 20 is supported via two ceramic insulators 18 on the collecting grid 15 located underneath. For this purpose, the grid 15 has two overhanging plates 17. The insulators 18 insulate the respective electrode 20 electrically against the collecting grid 15.

Current is supplied to the three electrodes 20 via a bar 41 each of which is connected at one end to the bottom 21 of an electrode 20 via a connecting strip 43 and is brought out at the other end through a radially disposed stub 42 of the vessel 1. The bars 41 are enclosed by insulators 40. The three phases of a three-phase network are connected to the outer ends of the bars 41 in a manner not shown in detail.

A group of several nozzles 13 is associated with each electrode 20 and are disposed in the intermediate plate 12 to define openings through which vertical water jets are directed against the associated electrode 20. A pipe line 51 is connected to the vessel 1 closely below the intermediate plate 12 and conducts the saturated steam generated in the vessel 1 to the consumers (not shown).

The generator also has means for feeding the water jets from the distribution means to a selective number less than all of the outlets of each electrode 20 at partial load of the generator. To this end, a means for selectively intercepting the flow of water in the jets between the distribution means and the electrodes 20 is provided. This intercepting means includes three collecting trays 35 each of which is movable across the water jets in a manner proportional to the distance moved. For this purpose, the intermediate plate 12 is provided on the lower side with a pipe section 28 which is concentric with the central pipe 10 and has a flange 29 at a lower end. The flange 29 has an annular slot of circular cross-section on the upper side in which balls 30 roll and a ring 31 of angular cross-section extends over the balls 30 so that an axial bearing is formed. The three collecting trays 35 are distributed circumferentially over the ring 31 and are welded to the ring 31. Each tray 35 is associated with one of the three groups of nozzles 13 and can be swung into the area of the water jets coming from these nozzles 13. Each of the collecting trays 35 is provided with a spout 36 (FIG. 2) which is pointed toward the wall of the vessel 1 and can move, together with the collecting tray 35, over the opening of a collecting pocket 38. The collecting pockets 38 are each formed by a metal sheet 56 which is welded to the inside of the vessel and extends downward to shortly above the water sump. If the collecting trays 35 are swung into the area underneath the nozzle 13, part of the water jets is therefore intercepted by means of the collecting trays 35 and the water collected is conducted into the collecting pockets 38, so that this intercepted water does not come into contact with the electrodes 20 and therefore does not carry current.

The sump, elbow 4, pump 7 and pipe 10 form a means for recirculating the water from the collecting grids 15 to the distribution means, i.e. to the plate 12 and nozzles 13.

The operation of the steam generator is as follows:

By means of the circulating pump 7, water is drawn from the sump and pumped via the central pipe 10 onto the intermediate plate 12, where a water layer is formed, the height of which depends on the amount of water pumped by the circulating pump 7 and on the sum total of the exit cross sections of all nozzles 13. A pipe 52 is provided for pressure equalization between the space above and the space below the intermediate plate 12. This pipe 52 also serves as an overflow. The water collecting on the intermediate plate 12 is distributed over the nozzle 13 and falls in a multiplicity of vertical jets onto the grid 25 of the dish-shaped electrodes 20. The water collects in these dishes forming a level. Then, the water flows via the nozzles 55 onto the collecting grid 15 underneath and from there to the sump. The current fed-in via the bars 41 flows from the dish-shaped electrodes 20 on the one hand against the falling water, to the nozzles 13 and on the other hand, in the same direction as the falling water, to the collecting grid 15. The nozzles 13 as well as the connecting grids 15 are electrically connected to the vessel 1 and are at zero potential. When the current passes through the water jets, steam is generated. The steam is then collected below the intermediate plate 12 and leaves the vessel via the line 51.

Figure 2:
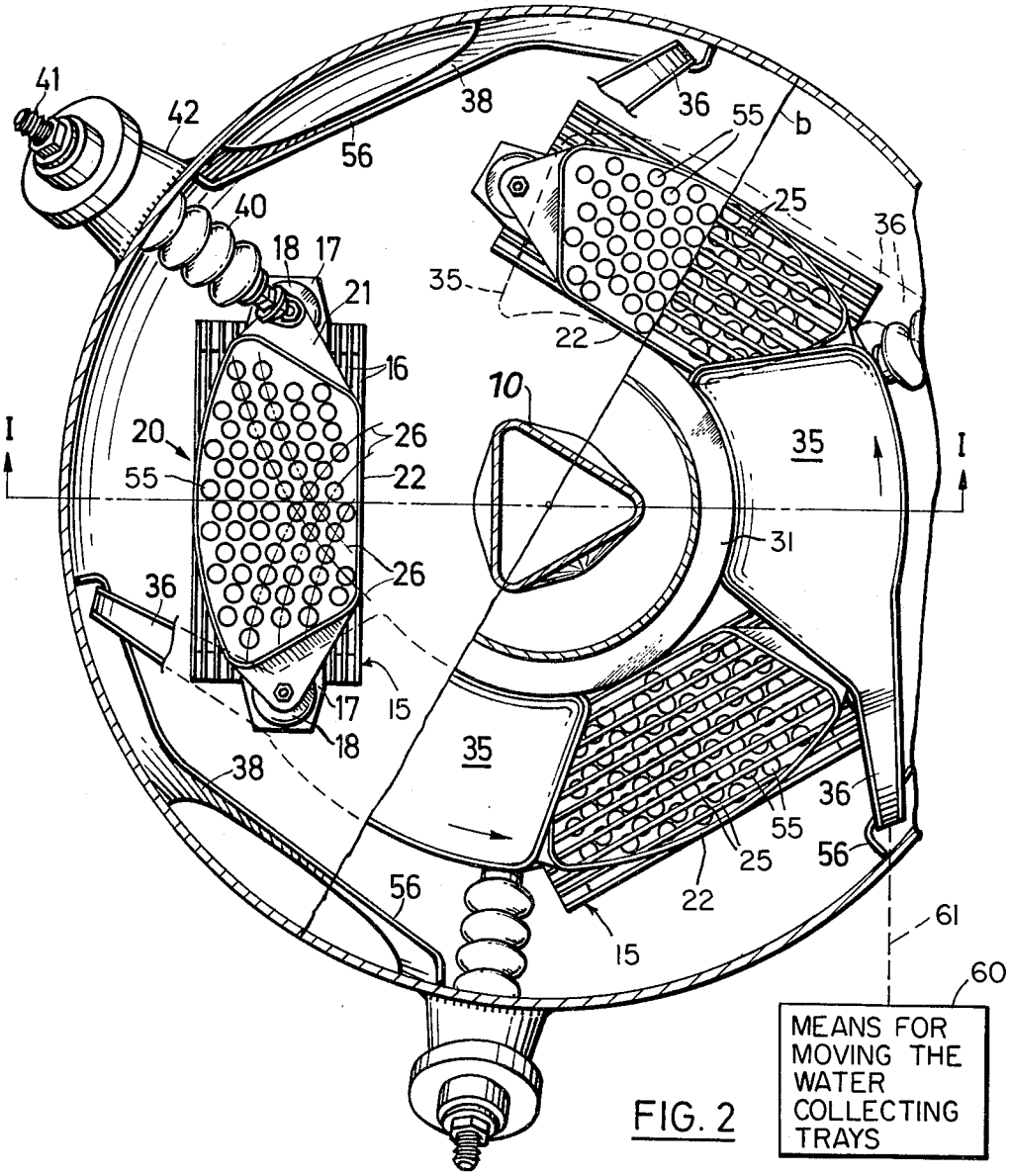
FIG. 2 illustrates a view taken on line II—II of FIG. 1.
Figure 3:
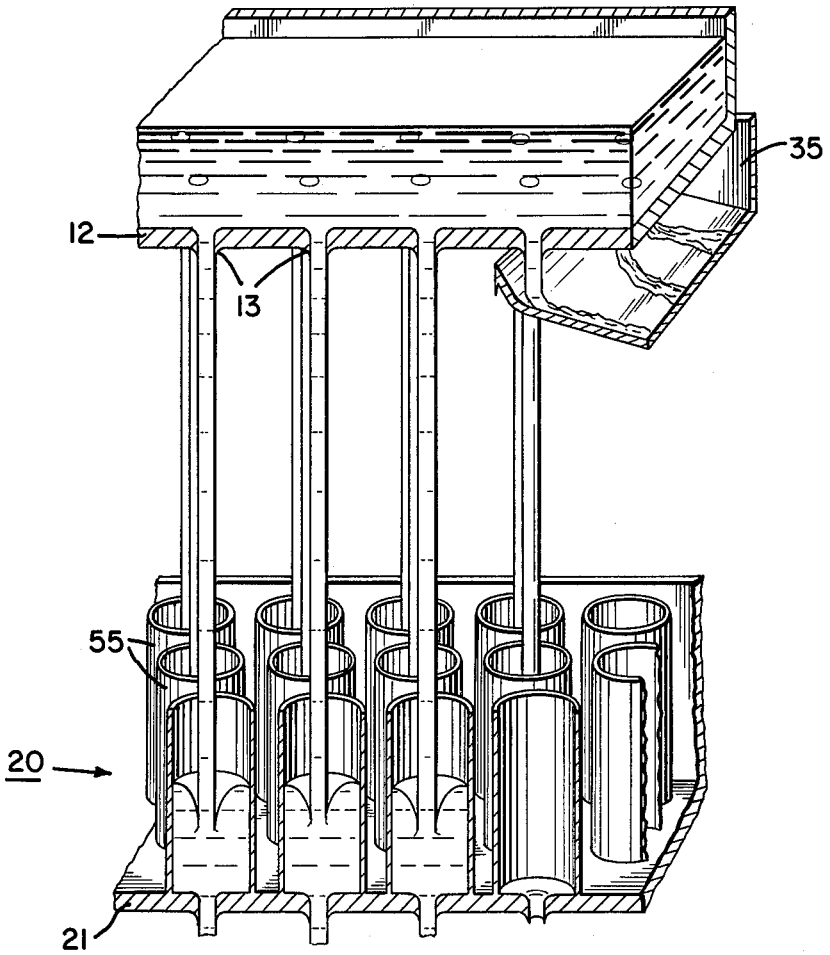
FIG. 3 illustrates a partial view of an electrode and a collecting tray at partial load.

At full load of the steam generator, the three collecting trays 35 are outside the area of the water jets issuing from the nozzles 13. For a smaller load, the ring 31 with the three collecting trays 35 is moved counter-clockwise in FIG. 2 by a suitable means so that the collecting trays intercept a larger or smaller part of the water issuing from the nozzles 13. As shown in FIG. 2, the means for moving the collecting trays 35 includes tray moving means 60 located externally of the vessel 1 and means 61 operatively connecting means 60 to a tray 35. The three collecting trays 35 are connected to each other for joint movement by ring 31. In the position shown in solid lines, all of the water jets flowing from the plates 12 of the distribution means reach the associated electrodes 20. By moving the collecting trays in the direction indicated by the illustrated arrow, more and more water jets are intercepted and water of these jets is collected in the trays 35. The collected water then flows via the spouts 36 into the collecting pockets 38 and returns to the water sump. In the position of the collecting trays 35 shown in dotted lines, all of the water jets are intercepted. By the specific arrangement of the nozzles 55 at the points of interception of two equidistant families of involutes, the number of water jets covered by the collecting trays 35 is varied approximately linearly as a function of the angle of rotation. Referring to FIG. 3, at a partial load, by intercepting a part of the water, a collecting tray 35 permits selective feeding of the water jets from the nozzles 13 in the plate 12 to a selective number less than all of the nozzles 55 in an electrode 20.

It may be advantageous to provide partitions about the individual nozzles 55 at the bottom of the dish-shaped electrodes 20 in such a manner that the water leaves the dish in approximately the same axis as the water enters. It is also conceivable to arrange partitions in the dishes in such a manner that the water is not distributed over a larger area or a larger number of jets leaving the electrodes than corresponds approximately to the number of the jets flowing toward the electrode. Finally, the height of the partitions can be arranged in steps. In this manner, at low load, the water which is fed-in in only a few jets can be prevented from discharging from too large a number of jets.

Instead of equipping the bottoms 21 and the intermediate plate 12 with nozzles 55 and 13, respectively, it is also possible to work nozzle-shaped discharge openings into the bottom 21 of the plate 12 itself.

The steam generator according to the invention may also be equipped with only one electrode instead of with three electrodes.

The invention is not limited to a vessel with a vertical axis. It is also possible to use cylindrical vessels with a horizontal axis, in which use the dish-shaped electrodes can be aligned with the direction of the horizontal axis. Similarly, the collecting trays are then also arranged to be axially movable.

What is claimed is:

1. In an electric steam generator, the combination comprising a vessel;

at least one horizontally extending dish-shaped electrode in said vessel for receiving and heating a supply of water and having openings therein forming outlets for the received water to form vertical water jets;

a distribution means located above said at least one electrode, said distribution means having a chamber to receive water, said chamber including a horizontal bottom having a group of openings above each of said at least one electrode for directing vertical water jets against and into each of said at least one electrode;

means mounted for movement between each of said at least one electrode and said distribution means for selectively intercepting the flow of water in said water jets between said distribution means and each of said at least one electrode; and means for selectively moving said intercepting means across said latter water jets to intercept and to divert away from each of said at least one electrode a number of said latter water jets proportional to the distance moved between each of said at least one electrode and said distribution means.

2. In an electric steam generator as set forth in claim 1 which further comprises a collecting grid below and spaced from each of said at least one electrode to collect the water jets from each of said at least one electrode.

3. In an electric steam generator as set forth in claim 1 wherein said intercepting means permits selective feeding of the water jets from said distribution means to a selective number less than all of said outlets of each of said at least one electrode at partial load of the generator, the number of said water jets being in a ratio relative to the total number of the openings of a group in said chamber bottom equal to the ratio of said selective number of outlets of each of said at least one electrode to the total number of said outlets of each of said at least one electrode.

4. In an electric steam generator as set forth in claim 1 wherein said intercepting means includes a collecting tray between said chamber and each of said at least one electrode movably mounted about a vertical axis for selective movement into said water jets therebetween.

5. In an electric steam generator as set forth in claim 4 which further comprises a pipe coaxially of said vertical axis for feeding a flow of water to be evaporated to said chamber, each of said collecting trays being mounted on said pipe.

6. In an electric steam generator as set forth in claim 1 wherein at least one of said at least one electrode and said chamber have a plurality of nozzles therein forming said respective openings.

7. In an electric steam generator for generating steam from water, the combination comprising a vessel;

a plurality of electrodes in said vessel, each electrode being of horizontally extending dish-shaped for receiving a supply of water and having openings therein to discharge a plurality of downwardly directed water jets;

a plurality of water distribution means in said vessel, each means being located above a respective electrode and having a chamber with a bottom to receive water and a group of openings in said bottom above each respective electrode to discharge a plurality of downwardly directed water jets into said electrode;

means mounted for movement between each of said distribution means and each of said electrodes for selectively intercepting the flow of water in said jets between each said distribution means and respective electrode to divert the intercepted flow away from said respective electrode;

means for selecticely moving said intercepting means;

a plurality of collecting grids, each grid being disposed beneath a respective electrode to receive the water jets issuing therefrom; and means for supplying an electric current to each said electrode to cause evaporation of the water in said water jets issuing from each said chamber and each said electrode.

8. In an electric steam generator as set forth in claim 7 which further comprises means for recirculating water from said collecting grids to said distribution means.

* * * * *

UNITED STATES PATENT AND TRADEMARK OFFICE

CERTIFICATE OF CORRECTION

PATENT NO. : 4,109,137

DATED : August 22, 1978

INVENTOR(S) : Jaroslav Zabelka

It is certified that error appears in the above-identified patent and that said Letters Patent are hereby corrected as shown below:

Column 1, line 67, change "acroSs" to --across--

Column 4, line 12, after "13" insert --to divert the intercepted water away from the electrodes 20--

Column 4, line 53, change "of" to--or--

Column 6, line 31, change "selecticely" to --selectively--

Signed and Sealed this

*First* Day of *May 1979*

[SEAL]

*Attest:*

RUTH C. MASON
*Attesting Officer*

DONALD W. BANNER
*Commissioner of Patents and Trademarks*